US008012274B2

(12) United States Patent
Skaff

(10) Patent No.: US 8,012,274 B2
(45) **Date of Patent: *Sep. 6, 2011**

(54) MECHANICAL PARTS HAVING INCREASED WEAR-RESISTANCE

(75) Inventor: Habib Skaff, Tampa, FL (US)

(73) Assignee: Skaff Corporation of America, Inc., Tampa, FL (US)

( * ) Notice: Subject to any disclaimer, the term of this patent is extended or adjusted under 35 U.S.C. 154(b) by 433 days.

This patent is subject to a terminal disclaimer.

(21) Appl. No.: 12/052,990

(22) Filed: Mar. 21, 2008

(65) Prior Publication Data

US 2008/0233428 A1 Sep. 25, 2008

Related U.S. Application Data

(60) Provisional application No. 60/896,468, filed on Mar. 22, 2007.

(51) Int. Cl.
*C21D 1/09* (2006.01)
*H05H 1/24* (2006.01)

(52) U.S. Cl. ..... 148/525; 148/241; 148/565; 427/569; 427/573; 427/576; 427/590

(58) Field of Classification Search ..... 148/241, 148/525, 400, 306, 320, 421, 425, 565; 427/569, 427/573, 576, 590
See application file for complete search history.

(56) References Cited

U.S. PATENT DOCUMENTS

| | | | |
|---|---|---|---|
| 2,025,060 | A | 12/1935 | Kormann et al. |
| 2,046,914 | A | 7/1936 | Kormann et al. |
| 3,164,215 | A | 1/1965 | Johnson |
| 3,793,160 | A | 2/1974 | Homan |
| 3,926,327 | A | 12/1975 | Schickdanz |
| 4,016,013 | A | 4/1977 | Bitzer et al. |
| 4,533,004 | A | 8/1985 | Ecer |
| 4,610,437 | A | 9/1986 | Baudis et al. |
| 4,637,837 | A | 1/1987 | Von Matushka et al. |
| 4,725,508 | A | 2/1988 | Rangaswamy et al. |
| 4,746,554 | A | 5/1988 | Ecer |
| 4,851,255 | A | 7/1989 | Langendik et al. |
| 5,009,000 | A | 4/1991 | Wilmeth et al. |
| 5,328,763 | A | 7/1994 | Terry |
| 5,861,630 | A | 1/1999 | Becker |
| 6,011,248 | A | 1/2000 | Dennis |
| 6,230,610 | B1 | 5/2001 | Pippert |
| 6,245,162 | B1 | 6/2001 | Baudis et al. |
| 6,306,225 | B1 | 10/2001 | Hunger et al. |
| 6,463,843 | B2 | 10/2002 | Pippert |
| 6,617,057 | B2 | 9/2003 | Gorokhovsky et al. |
| 6,723,279 | B1 | 4/2004 | Withers et al. |
| 6,783,794 | B1 | 8/2004 | Cabeo et al. |
| 6,830,441 | B1 | 12/2004 | Williams |
| 6,855,081 | B2 | 2/2005 | Koschig |
| 6,878,434 | B2 | 4/2005 | Kujioka et al. |
| 7,139,219 | B2 | 11/2006 | Kolle et al. |
| 2002/0189716 | A1 | 12/2002 | Savich |
| 2005/0139236 | A1 | 6/2005 | Kool et al. |

(Continued)

OTHER PUBLICATIONS

Brandstotter, et. al.: "Multiphase reaction to diffusion in transition metal-boron systems" Journal of Alloys and Compounds, 262-263 (1997), 390-396.

(Continued)

*Primary Examiner* — Deborah Yee
(74) *Attorney, Agent, or Firm* — Andrea L. C. Robidoux; Choate, Hall & Stewart, LLP

(57) ABSTRACT

The present invention relates to wear-resistant mechanical parts.

14 Claims, 4 Drawing Sheets

1a

1b

1c

| Element | % Weight | % Weight Sigma | Atom % |
|---|---|---|---|
| C K | 4.46 | 0.52 | 7.75 |
| O K | 62.62 | 0.44 | 76.45 |
| Na K | 0.55 | 0.08 | 0.47 |
| Si K | 0.57 | 0.04 | 0.39 |
| Cl K | 2.25 | 0.06 | 1.24 |
| K K | 25.76 | 0.25 | 12.87 |
| Fe K | 3.79 | 0.11 | 1.32 |

U.S. PATENT DOCUMENTS

| | | | |
|---|---|---|---|
| 2005/0163647 | A1 | 7/2005 | Donahue et al. |
| 2005/0178558 | A1 | 8/2005 | Kolle et al. |
| 2005/0208213 | A1 | 9/2005 | Chandran et al. |
| 2005/0208218 | A1 | 9/2005 | Becker et al. |
| 2006/0165973 | A1 | 7/2006 | Dumm et al. |
| 2007/0098917 | A1 | 5/2007 | Skaff |
| 2008/0029305 | A1 | 2/2008 | Skaff |

OTHER PUBLICATIONS

Hunger, et. al.: "Generation of boride layers on steel and nickel alloys by plasma activation of boron trifluoride" Thin Solid Films 310 (1997) 244-250.

Iakovou, et. al.: "Synthesis of boride coats on steel using plasma transferred arc (PTA) process and its wear performance" Wear 252 (2002) 1007-1015.

Knotek, et. al.: "Surface layers on cobalt base alloys by boron diffusion", paper presented at the International Conference on Metallurgical Coatings, San Francisco, CA, Mar. 28-Apr. 1, 1977.

Kuper, et. al.: "A novel approach to gas boronizing" Surface and Coatings Technology 130 (2000) 87-94.

Kwok, et. al.: "Profile control in BF3 plasma doping" Journal of Applied Physics, vol. 88, No. 6, 2000, pp. 3198-3200.

Piekoszewski, et. al.: "Modification of the surface properties of materials by pulsed plasma beams" Surface and Coatings Technology 106 (1998) 228-233.

Yu, et. al.: "Bonding of mild steel using the spark plasma sintering (SPS) technique" Surface and Coatings Technology 157 (2002) 226-230.

Choy, "Chemical vapour deposition of coatings" Progress in Materials Science 48 (2003) p. 57-170.

Sun, Y. of Alloys and Compounds 231 (1995) pp. 380-386.

1a

1b

1c

| Element | % Weight | % Weight Sigma | Atom % |
|---|---|---|---|
| C K | 4.46 | 0.52 | 7.75 |
| O K | 62.62 | 0.44 | 76.45 |
| Na K | 0.55 | 0.08 | 0.47 |
| Si K | 0.57 | 0.04 | 0.39 |
| Cl K | 2.25 | 0.06 | 1.24 |
| K K | 25.76 | 0.25 | 12.87 |
| Fe K | 3.79 | 0.11 | 1.32 |

2a

2b

2c

| Element | % Weight | % Weight Sigma | Atom % |
|---|---|---|---|
| B K | 43.47 | 23.48 | 57.66 |
| C K | 6.26 | 2.93 | 7.47 |
| O K | 32.26 | 13.41 | 28.91 |
| Na K | 0.31 | 0.13 | 0.19 |
| Si K | 0.25 | 0.11 | 0.13 |
| Cl K | 0.38 | 0.16 | 0.15 |
| K K | 10.01 | 4.16 | 3.67 |
| Fe K | 7.06 | 2.93 | 1.81 |

3a

3b

3c

| Element | % Weight | % Weight Sigma | Atom % |
|---|---|---|---|
| C K | 6.17 | 0.72 | 23.40 |
| Fe K | 93.83 | 0.72 | 76.60 |

MECHANICAL PARTS HAVING INCREASED WEAR-RESISTANCE

CROSS-REFERENCE TO RELATED APPLICATIONS

The present application claims priority to U.S. provisional patent application Ser. No. 60/896,468, filed Mar. 22, 2007, the entirety of which is hereby incorporated herein by reference.

BACKGROUND OF THE INVENTION

The production of very hard surfaces of borides on metal articles by diffusion of boron into the surfaces thereof, has long been known. For this purpose it is possible, for example, to use gaseous boriding agents, such as diborane, boron halides, and organic boron compounds, as well as liquid substances, such as borax melts, with viscosity-reducing additives, with or without the use of electric current. The use of such boriding agents, however, has never gained commercial importance due to the fact that they are not very economical, they are toxic, and because of the non-uniformity of the boride layers obtained therewith. As a result, it remains desirable to provide a metallic object, having at least a portion of a surface of the object that is borided and therefore wear-resistant.

DETAILED DESCRIPTION OF CERTAIN EMBODIMENTS

Substrates

Figure 1:
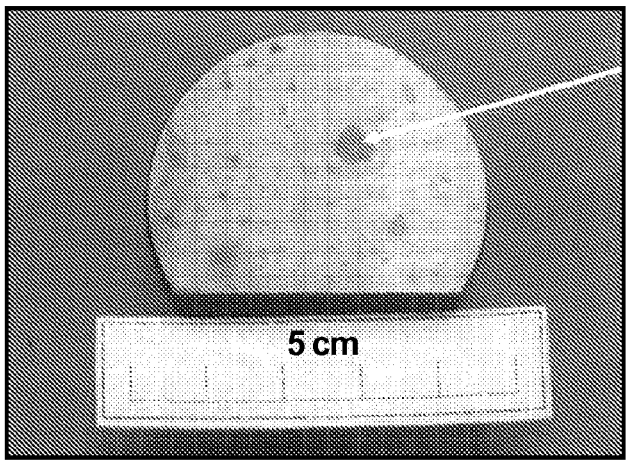
FIG. 1 depicts the SEM spectrum and quantitative results of a sample
Figure 1:
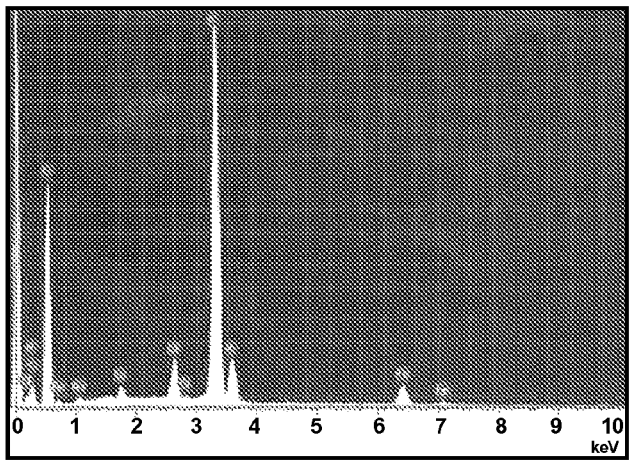

In certain embodiments, the present invention provides an object wherein at least a portion of a surface of the object comprises a material that is borided. In some embodiments, the present invention provides an object wherein at least a portion of a surface of the object comprises a metallic material that is borided. Such objects include any metallic object, or portion thereof, that is suitable for boriding and would benefit from the effects of boriding. One of ordinary skill in the art will recognize that numerous objects, or a portion thereof, would benefit from the wear-resistance imparted upon metallic surfaces by the process of boriding. Objects having at least a portion subject to wear by corrosion, abrasion, or erosion would particularly benefit from the wear-resistant effects of boriding. Such objects include those used in the automotive, aerospace, farming, ocean vessel, medical, dental, construction, sports equipment, ballistics, and household industries. One of ordinary skill in the art will recognize that many other wear-resistant objects are contemplated.

The object, or a portion thereof, may be fabricated from a ferrous or non-ferrous metal or metal alloy. In some embodiments, the metal or metal alloy may be steel, titanium, or a titanium or chromium alloy. In certain embodiments, the object, or a portion thereof, is substantially metallic, or may be at least 5% metallic, at least 10% metallic, at least 15% metallic, at least 20% metallic, at least 25% metallic, at least 30% metallic, at least 35% metallic, at least 40% metallic, at least 45% metallic, at least 50% metallic, at least 55% metallic, at least 60% metallic, at least 65% metallic, at least 70% metallic, at least 75% metallic, at least 80% metallic, at least 85% metallic, at least 90% metallic, or at least 95% metallic.

Typical substrate materials include steel alloys, such as stainless steels, titanium alloys, nickel base and cobalt base super-alloys, dispersion-strengthened alloys, composites, single crystal and directional eutectics. In certain embodiment, the substrate material is a stainless steel or a titanium alloy. In some embodiments, the substrate material is a cobalt-containing or silicon-containing material. In other embodiments, the substrate material is silicon.

Examples of some of the nominal compositions of typical substrate materials that are in accordance with the features of the present invention include AM350(Fe, 16.5Cr, 4.5Ni, 2.87Mo, 0.10C); AM355(Fe, 15.5CR, 4.5Ni, 2.87Mo, 0.12C); Custom 450(Fe, 15Cr, 6Ni, 1 Mo, 1.5Cu, 0.5Cb, 0.05C); Ti-6Al-4V; Ti-6Al-25n-4zr-2Mo; Ti-6Al-25n-4Zr-6Mo; and Ti-10V-2Fe-3Al.

In certain embodiments, the wear-resistant object comprises an iron-containing metal. Iron-containing metals are well known to one of ordinary skill in the art and include steels, high iron chromes, and titanium alloys. In certain embodiments, the iron-containing metal is a stainless steel or 4140 steel. In other embodiments, the stainless steel is selected from 304, 316, 316L steel. According to one embodiment, the iron-containing metal is a steel selected from 301, 301L, A710, 1080, or 8620. In other embodiments, the metal surface to be boronized is titanium or a titanium-containing metal. Such titanium-containing metals include titanium alloys.

As described generally above, wear-resistant objects of the present invention include those used in the medical industry. Such objects are well known in the art and include surgical instruments, such as instruments having teeth, serrations, a cutting edge, or being otherwise susceptible to wear a surgical instrument having a cutting edge which does not need frequent sharpening. "Surgical scissors," as used herein, means straight, curved, acutely curved and very acutely curved scissors for surgical use. The present invention also contemplates other stainless steel or titanium surgical instruments, including, without limitation, cutting instruments (e.g. scalpels), grasping and holding instruments, electrosurgical instruments, cautery instruments, needle holders, osteotomes and periosteotomes, chisels, gouges, rasps, files, saws, reamers, wire twisting forceps, wire cutting forceps, ring handled forceps, tissue forceps, cardiovascular clamps, and rongeurs. Also contemplated are objects for use in orthopedics including screws, pins, wires, and the like.

In other embodiments, the present invention provides an implantable device having at least a portion that is wear-resistant in accordance with the present invention. Such implantable medical devices are well known in the art. Representative examples of implants and surgical or medical devices contemplated by the present invention include cardiovascular devices (e.g., chronic infusion lines or ports, pacemaker wires, implantable defibrillators); neurologic/neurosurgical devices (e.g., ventricular peritoneal shunts, ventricular atrial shunts, nerve stimulator devices; Additional implantable medical devices include esophageal stents, gastrointestinal stents, vascular stents, biliary stents, colonic stents, pancreatic stents, ureteric and urethral stents, lacrimal stents, Eustachian tube stents, fallopian tube stents and tracheal/bronchial stents.

In other embodiments, wear-resistant objects of the present invention are those used in the dental or orthodontic industries. Such objects are well known in the art and include cleaning tools, braces, Mara apparatus, orthodontic wire, brackets, molar bands, ligatures, and the like.

In certain embodiments, wear-resistant objects of the present invention are those used in the automotive industry. Such objects are well known in the art and include shock absorbers, springs, gears, rotors, calipers, bearings, brake rotors, calipers, car frames, and internal combustion engine parts including valves, pistons, cylinder, spark plugs, drive shaft, crank shaft, cam shaft, rocker arms, timing gears, timing chain, heads, block, fan blades, manifold, universal joints, transmission parts, cylinder lining, and gas lines, to name a few.

In certain embodiments, wear-resistant objects of the present invention multiple edge or single edge cutting tools. Such objects are well known in the art and include knives, razors, scissors, sickles, utility knife blades, stone-cutting blades, mower blades, axes, hatchets, saw blades (e.g. circular saw blades, chain-saw blades, hack saw blades, jigsaw blades, reciprocating saw blades, band saw blades, and concrete saw blades), lathes, planer blades (eg block plane, jack plane), shaper blades, and the like.

In certain embodiments, the present invention provides a wear-resistant tool. Tools are well known in the art and included hand tools and machine tools. Exemplary tools include chasers, wrenches, hammers, screwdrivers, pliers, lock mechanisms, knurling tools, ratchet sockets, chisels, router bits, drill bits, broaches, drills, gears shapers, hones, lathes, shapers, grinders, and files.

In certain embodiments, the present invention provides a wear-resistant fastener. Fasteners are well known in the art and include nails, screws, staples, bolts, nuts, washers, hinges, clips, chain links, locks, clamps, pins (e.g. cotter pin), hooks, pulleys, and rivets.

In other embodiments, the present invention provides a wear-resistant wire. Wires are well known in the art and include wire for medical use, cable (i.e. wire rope), and wire for use in musical instruments (e.g. piano wire or guitar string).

In certain embodiments, the present invention provides a wear-resistant mechanical part, or portion thereof, for use in heavy equipment, including farming equipment. One of ordinary skill in the art will recognize that many components of heavy equipment would benefit from wear-resistance in accordance with the present invention. Such mechanical parts and equipment include plows, hoes, combine parts, wheel barrows, pitchforks, roll cages, shovels, trailer hitches, bulldozer blades, excavator buckets, grader blades, draggers, snow plows, wheels, tracks (eg bulldozer), drilling machines, pile drivers, pavers, harvesters, roller-compacters, skid loaders, trenchers, and cranes.

In certain embodiments, the present invention provides a wear-resistant mechanical part, or portion thereof, for use in sporting equipment. One of ordinary skill in the art will recognize that many components of sporting equipment would benefit from wear-resistance in accordance with the present invention. Such components and sporting goods include golf clubs (e.g. shaft and head), ice skate blades, ski edges, snow board edges, horse shoes, dart tips, and the like.

In other embodiments, the present invention provides a wear-resistant mechanical part, or portion thereof, for use in aircraft, including jet engines. One of ordinary skill in the art will recognize that many components of aircraft would benefit from wear-resistance in accordance with the present invention. Such components include turbines, fan blades, nozzles, rotors, propellers, and the like.

In other embodiments, the present invention provides a wear-resistant mechanical part, or portion thereof, such as bullets, shell casings, gun/rifle barrels, gun/rifle hammers, arrow heads and shafts, sword blades, armor, and the like.

In still other embodiments, the present invention provides a wear-resistant mechanical part, or portion thereof, for use in nautical equipment, including boats and docks. One of ordinary skill in the art will recognize that many components of nautical equipment would benefit from wear-resistance in accordance with the present invention. Such components include sail boat masts, anchors, propellers, ship hulls, hooks, and cleats, among others.

Boriding

The use of diffusion-based treatments such as nitriding, carburization, and boriding to increase surface hardness and resistance to wear is well known. Boriding can produce a harder surface than nitriding or carburization and is suitable for some steel alloys for which nitriding or carburization are less optimal. Boriding also improves the corrosion resistance and reduces the coefficient of friction more than carburization, increasing the lifetime of parts. Even a 10% improvement in part life can create immense savings over the course of utilizing an object in accordance with the present invention.

Various methods of boronizing metallic surfaces are known. Such methods produce a boron layer on a metal surface. Typically, these methods utilize reactive boron species which diffuse into the metal surface. Such reactive boron species include gaseous diborane and boron trihalides, including $BCl_3$ and $BF_3$. Other techniques for increasing surface hardness include the simple deposition of a boron-containing layer at the surface of a material. For example, electrochemistry may be employed to form a layer of iron boride at the surface of a component.

Alternatively, superabrasive composites including materials such as diamond or cubic boron nitride may be electroplated onto metallic components, or metal/metal boride mixtures may be thermally sprayed onto components. However, layers formed by these methods may not be chemically or mechanically integrated with the bulk material. Boriding provides greater integration of the boron-containing layer with the substrate. This integration increases the strength of the interface between the boride-containing layer and the substrate, further reducing galling, tearing, seizing, and other forms of wear in which a material flakes from the surface.

One method for boriding metallic surfaces is the "pack" method. In this method, the boron source is in the form of a solid powder, paste, or in granules. The metal surface is packed with the solid boron source and then heated to release and transfer the boron species into the metal surface. This method has many disadvantages including the need for using a large excess of the boron source resulting in the disposal of excessive toxic waste.

Another method for boriding metallic surfaces is the "paste" method. Such pastes are applied by dipping, brushing, or spraying. Paste consistency is variable within wide limits.

Another method for boriding metallic surfaces utilizes a plasma charge to assist in the transfer of boron to the metal surface. Typically, plasma boronization methods utilize diborane, $BCl_3$, or $BF_3$ where the plasma charge is applied to the gaseous boron-containing reagent to release reactive boron species. See U.S. Pat. Nos. 6,306,225 and 6,783,794, for example. However, these methods utilize corrosive and highly toxic gases and are thus difficult to utilize on an industrial scale.

Plasma boriding processes have several advantages, including speed and localized heating of the substrate. This prevents the bulk metal in the borided piece from annealing, obviating additional heat treatments to restore the original microstructure and crystal structure.

In another embodiment, a potassium haloborate may be decomposed to the potassium halide salt and the boron trihalide, which is then fed into an inert gas stream for plasma boriding. In one embodiment, the potassium haloborate is potassium fluoroborate. It is contemplated that this technique facilitates boriding of larger parts more economically and safely than plasma boriding techniques employing organoborates or boron halides.

Use of $KBX_4$ is advantageous in that it is a solid substance which is readily available and easily handled. In certain embodiments, $KBX_4$ is provided in solid form in the presence of a metal surface to be borided. Heat is applied such that the $KBX_4$ releases $BX_3$ gas to which a plasma charge is applied. Without wishing to be bound by any particular theory, it is believed that the plasma charge results in the formation of one or more active boron species which diffuse into the metal surface. As used herein, the term "activated boron species" refers to any one or more of the boron species created from applying the plasma charge to the gas resulting from heating $KBX_4$. In certain embodiments, the one or more activated boron species include, but are not limited to, $B^+$, $BX^+$, $BX_2^+$, and $BX_3^+$.

As used herein, the terms "boriding" and "boronizing" are used interchangeably and refer to the process of incorporating a boron layer on a metal surface.

As used herein, the term "plasma" refer to an ionized gas and the term "plasma charge" refers to an electric current applied to a gas to form a plasma. In certain embodiments, a plasma for use in the present invention comprises one or more activated boron species including, but not limited to, $B^+$, $BX^+$, $BX_2^+$, and $BX_3^+$, wherein each X is a halogen.

As used herein, the term "glow discharge" refers to a type of plasma formed by passing a current at 100 V to several kV through a gas. In some embodiments, the gas is argon or another noble gas.

In certain embodiments, each X is chlorine and the $KBX_4$ is $KBCl_4$.

In other embodiments, each X is fluorine and the $KBX_4$ is $KBF_4$.

In certain embodiments, the present invention provides any of the objects described above and herein, wherein at least a portion of a surface of the object comprises a metallic material that is borided by a method comprising the steps of:

(a) providing $KBX_4$, wherein each X is halogen;

(b) heating the $KBX_4$ at a temperature sufficient to release $BX_3$; and (c) applying a plasma charge to the $BX_3$ to create one or more activated boron species for diffusing into the metal surface.

In other embodiments, the boriding method comprises the steps of:

(a) providing $KBX_4$, wherein each X is halogen, in the presence of the metal surface;

(b) heating the $KBX_4$ at a temperature sufficient to release $BX_3$; and (c) applying a plasma charge to the $BX_3$ to create one or more activated boron species for diffusing into the metal surface.

In certain embodiments, the metal surface to be boronized is an iron-containing metal. Iron-containing metals are well known to one of ordinary skill in the art and include steels, high iron chromes, and titanium alloys. In certain embodiments, the iron-containing metal is a stainless steel or 4140 steel. In other embodiments, the stainless steel is selected from 304, 316, 316L steel. According to one embodiment, the iron-containing metal is a steel selected from 301, 301L, A710, 1080, or 8620. In other embodiments, the metal surface to be boronized is titanium or a titanium-containing metal. Such titanium-containing metals include titanium alloys.

In other embodiments, the $KBX_4$ is provided in solid form in a chamber containing the metal surface to be borided. The $KBX_4$ is heated to release $BX_3$. A plasma charge is applied at the opposite side of the chamber to create a plasma comprising one or more activated boron species. The temperature at which the $KBX_4$ is heated is sufficient to release $BX_3$ therefrom. In certain embodiments, the $KBX_4$ is heated at a temperature of 700 to 900° C.

The amount of $KBX_4$ utilized in methods of the present invention is provided in an amount sufficient to maintain a pressure of about 10 to about 1500 Pascals within the reaction chamber. In certain embodiments, the pressure is from about 50 to about 1000 Pascals. In other embodiments, the pressure is from about 100 to about 750 Pascals. One of ordinary skill in the art will appreciate that the thermodecomposition of $KBX_4$ to $BX_3$ results in an increase of pressure within the reaction chamber. Without wishing to be bound by any particular theory, it is believed that the number of moles of $BX_3$ gas created may be calculated by measuring the increase of pressure.

In certain embodiments, hydrogen gas is introduced into the chamber with the $KBX_4$ and $BX_3$ resulting from the thermodecomposition thereof. Without wishing to be bound by any particular theory, it is believed that elemental hydrogen facilitates the decomposition of $BX_3$ into the one or more activated boron species upon treatment with the plasma charge. In certain embodiments, hydrogen gas is introduced in an amount that is equal to or in molar excess as compared to the amount of $BX_3$ liberated.

In some embodiments, the $BX_3$ and optional hydrogen gases are carried into a plasma by a stream of an inert gas, for example, argon. The plasma allows quicker diffusion of reactive elements and higher velocity impact of reactive boron species against the metal surface being treated. In certain embodiments, the plasma is a glow plasma. The substrate may be any material that is suitable for use with plasma treatment methods, for example, steels or titanium alloys. The $KBX_4$ may be decomposed in a separate decomposition chamber connected to the plasma chamber, or both the decomposition and the plasma treatment may occur in separate areas of a single reaction vessel.

As described herein, methods of the present invention include the step of applying a plasma charge to create one or more activated boron species. In certain embodiments, the plasma charge is a pulsed plasma charge. In other embodiments, the plasma charge is applied wherein the voltage is regulated from between about 0 to about 800 V. In still other embodiments, the amperage is about 200 A max.

EXAMPLES

Example 1

A steel part is placed into a reaction chamber along with 50 g $KBF_4$ in a boron nitride crucible. The reaction chamber is evacuated to 0.01 Pa. The crucible is heated to 900° C. resulting in decomposition of $KBF_4$ to $BF^3$. A 10% $H_2/Ar_2$ gas mixture is added to the reaction chamber to a pressure of 500 Pa. An electrical discharge is applied at 600 V and 150 Amps. The reaction is continued for about 3 hours or until desired boron penetration is accomplished.

Example 2

Figure 4:
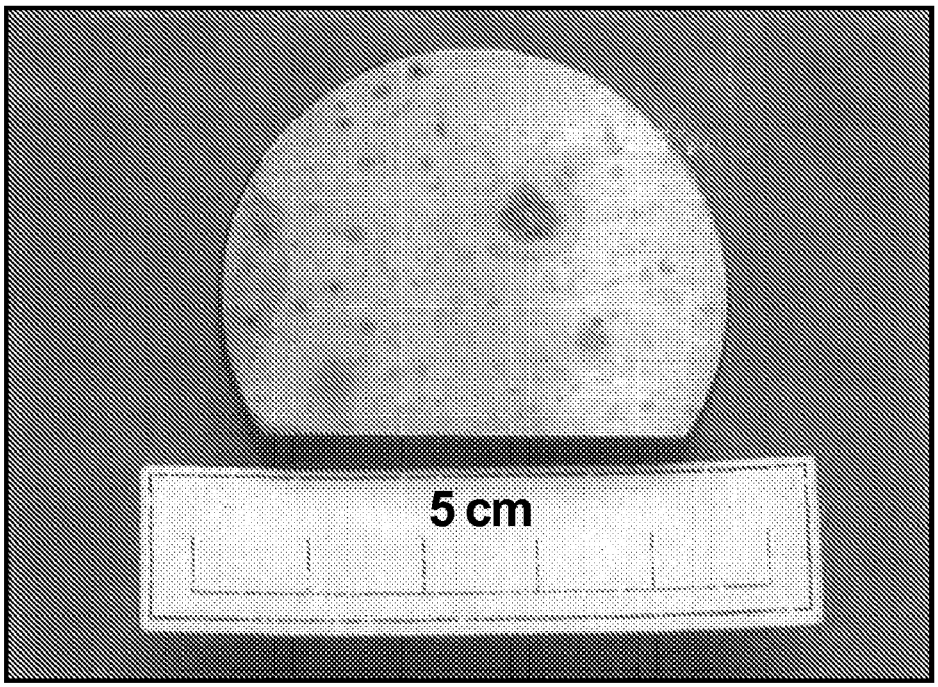
FIG. 4 depicts a starting sample.

A "disk prototype", (FIG. 4), with a diameter of 45 mm and a thickness (or gauge) of 15 mm., which had been manufactured out of ARMCO iron. It was known that this prototype had been subjected to a heat treatment of approximately 450-500 centigrade. The assembly was further identified by the letter A on its surface. This prototype exhibited, on both the front and lateral surfaces, marks of "surface adhesion", which were to be analyzed by means of scanning electron microscope medium-energy-dispersing x-ray analysis.

The surface analysis was conducted by means of the scanning electron microscope middle-energy-dispersing x-ray analysis (EDX). All measurements/readings were conducted with an acceleration voltage of 20 kV. In principle, through the EDX measurements, a qualitative estimation of the carbon content can be observed with this analytical method.

Initially, the EDX Spectra had been recorded in two positions of the flecked surface adhesion. The first spectrum from one of the larger marks showed high quantities of oxygen (62.62%) and Potassium (25.76%) (FIG. 1). Additionally, the elements Sodium (0.55%), Chlorine (2.25%) and Silicon (0.57%) were detected. The remaining portion of the iron (3.79%) had to be assigned to the basic material. In FIG. 1, picture 1*a* depicts the marking of the measurement position; picture 1*b* depicts the SEM spectrum of the area in picture 1*a*; and picture 1*c* depicts the quantitative results of the SEM spectrum from picture 1*b*.

Figure 2:
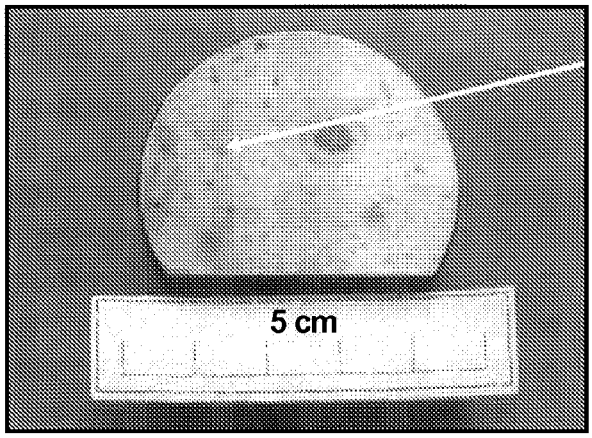
FIG. 2 depicts the SEM spectrum and quantitative results of a sample.
Figure 2:
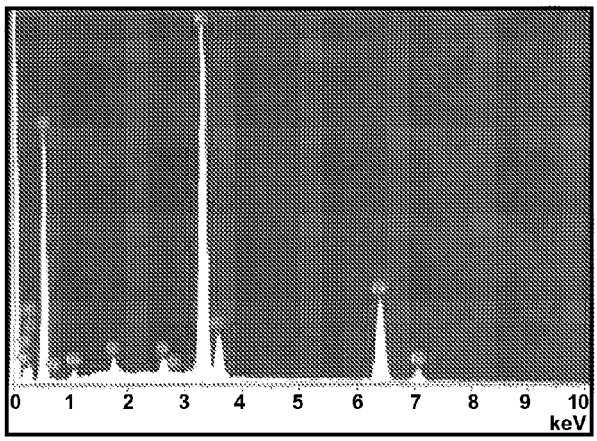

The second surface analysis on one of the smaller flecks (FIG. 2) showed additionally, in comparison to the elements found in the first measurement, significantly high boron content (43.47%). The alkali-metals sodium (0.31%) and Potassium (10.01%), as well as the elements Silicon (0.25%) and Chlorine (0.38%) lay clearly under the values of the measurement of the larger spot. The oxygen content had halved itself by nearly 32%. In FIG. 2, picture 2*a* depicts the measurement position for the SEM measurement; picture 2*b* depicts the SEM spectrum of the area in picture 2*a*; and picture 2*c* depicts the quantitative results of the SEM measurement.

Figure 3:
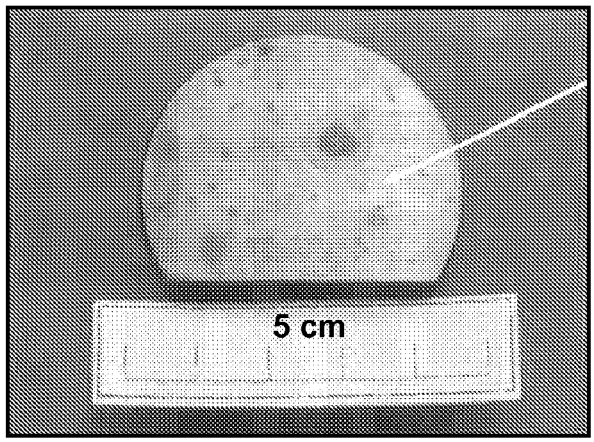
FIG. 3 depicts the SEM spectrum and quantitative results of a sample.
Figure 3:
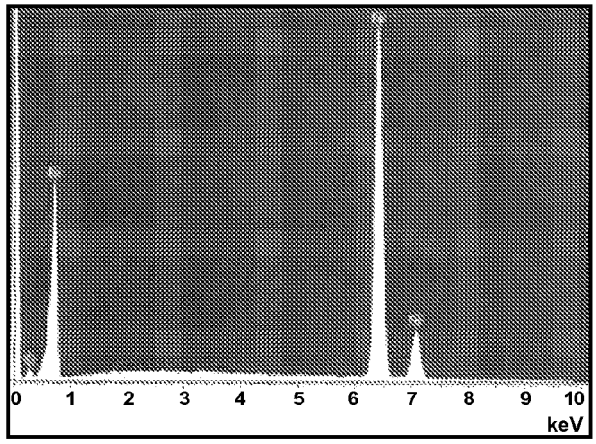

In the last measurement, the surface area had been measured in an unaffected (FIG. 3). In this position, it shows a typical composition of ARMCO-iron. In FIG. 3, picture 3*a* depicts the measurement position for the SEM measurement; picture 3*b* depicts the SEM spectrum of the area in picture 3*a*; and picture 3*c* depicts the quantitative results of the SEM measurement.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

I claim:

1. A method for preparing a wear-resistant object selected from a surgical instrument, an orthopedic object, an implantable device, a dental object, an automotive object, a cutting object, a tool, a fastener, farm equipment, sporting equipment a jet engine part, a wear resistant mechanical part, or nautical equipment, wherein at least a portion of a surface of the object comprises a material that is borided, said method comprising the steps of:

(a) providing $KBX_4$, wherein each X is halogen;

(b) heating the $KBX_4$ at a temperature sufficient to release $BX_3$; and (c) applying a plasma charge to the $BX_3$ to create one or more activated boron species for diffusing into the material surface, wherein:

the $KBX_4$ is in the presence of the metal surface in a single reaction vessel such that both thermal decomposition of the $KBX_4$ and plasma treatment of the metal surface occur in separate areas of the reaction vessel; or thermal decomposition of the $KBX_4$ occurs in a separate decomposition chamber connected to a reaction vessel containing the metal surface for plasma treatment of the metal surface.

2. The object according to claim 1, wherein said object comprises an iron-containing, cobalt-containing, titanium-containing, or silicon-containing material.

3. The object according to claim 1, wherein said object is a surgical instrument or an orthopedic object selected from a cutting instrument, a grasping and holding instrument, a electrosurgical instrument, a cautery instrument, a needle holder, an osteotome or periosteotome, a chisel, a gouge, a rasp, a file, a saw, a reamer, wire twisting forceps, wire cutting forceps, ring handled forceps, tissue forceps, a cardiovascular clamp, a rongeur, an orthopedic screw, an orthopedic pin, or an orthopedic wire.

4. The object according to claim 1, wherein said object is an implantable device selected from a cardiovascular device, a neurologic/neurosurgical device, or a stent.

5. The object according to claim 1, wherein said object is a dental or orthodontic object selected from cleaning tools, braces, Mara apparatus, orthodontic wire, brackets, molar bands, and ligatures.

6. The object according to claim 1, wherein said automotive object is selected from shock absorbers, springs, gears, rotors, calipers, bearings, brake rotors, calipers, car frames, valves, pistons, cylinder, spark plugs, drive shaft, crank shaft, cam shaft, rocker arms, timing gears, timing chain, heads, block, fan blades, manifold, universal joints, transmission parts, cylinder lining, and gas lines.

7. The object according to claim 1, wherein the cutting object is selected from knives, razors, scissors, sickles, utility knife blades, stone-cutting blades, mower blades, axes, hatchets, saw blades, lathes, planer blades, and shaper blades.

8. The object according to claim 1, wherein the tool is selected from chasers, wrenches, hammers, screwdrivers, pliers, lock mechanisms, knurling tools, ratchet sockets, chisels, router bits, drill bits, broaches, drills, gears shapers, hones, lathes, shapers, grinders, and files.

9. The object according to claim 1, wherein the fastener is selected from nails, screws, staples, bolts, nuts, washers, hinges, clips, chain links, locks, clamps, pins, hooks, pulleys, and rivets.

10. The object according to claim 1, wherein the farm equipment is selected from plows, hoes, combine parts, wheel barrows, pitchforks, roll cages, shovels, trailer hitches, bulldozer blades, excavator buckets, grader blades, draggers, snow plows, wheels, tracks, drilling machines, pile drivers, pavers, harvesters, roller-compacters, skid loaders, trenchers, and cranes.

11. The object according to claim 1, wherein the sporting equipment is selected from golf clubs, ice skate blades, ski edges, snow board edges, horse shoes, and dart tips.

12. The object according to claim 1, wherein the jet engine part is selected from turbines, fan blades, nozzles, rotors, and propellers.

13. The object according to claim 1, wherein the the second occurrence of wear resistant mechanical part is selected from bullets, shell casings, gun/rifle barrels, gun/rifle hammers, arrow heads and shafts, armor, and sword blades.

14. The object according to claim 1, wherein the nautical equipment is selected from sail boat masts, anchors, propellers, ship hulls, hooks, and cleats.

* * * * *